United States Patent [19]

Sindelar et al.

[11] 4,347,016

[45] Aug. 31, 1982

[54] METHOD AND APPARATUS FOR ASPHALT PAVING

[76] Inventors: Robert A. Sindelar, 606 E. South St.; Donald J. Alexander, 125 Webster St., both of Beaver Dam, Wis. 53916

[21] Appl. No.: 180,157

[22] Filed: Aug. 21, 1980

[51] Int. Cl.[3] ..... E01C 23/14

[52] U.S. Cl. ..... 404/95; 126/271.2 A

[58] Field of Search ..... 404/95, 91, 101, 108, 404/72; 180/14 R; 126/271.2 A

[56] References Cited

U.S. PATENT DOCUMENTS

| | | | |
|---|---|---|---|
| 2,254,463 | 9/1941 | Wells | 404/95 |
| 2,257,637 | 9/1941 | Moore | 404/95 X |
| 2,951,426 | 9/1960 | Pollitz | 404/95 |
| 3,361,042 | 1/1968 | Cutler | 404/95 X |
| 4,011,023 | 3/1977 | Cutler | 404/91 |
| 4,018,540 | 4/1977 | Jackson | 404/95 |
| 4,028,527 | 6/1977 | Thagard, Jr. | 219/311 |
| 4,124,325 | 11/1978 | Cutler | 404/95 X |
| 4,129,398 | 12/1978 | Schoelkopf | 404/95 |
| 4,172,679 | 10/1979 | Wirtgen | 404/95 X |
| 4,175,885 | 11/1979 | Jeppson | 404/95 X |
| 4,226,552 | 10/1980 | Moench | 404/91 X |
| 4,252,459 | 2/1981 | Jeppson | 404/95 X |
| 4,252,487 | 2/1981 | Jeppson | 404/95 X |
| 4,261,669 | 4/1981 | Edo | 404/95 X |
| 4,272,212 | 6/1981 | Bauer | 404/91 X |
| 4,276,093 | 6/1981 | Pickermann | 404/95 X |

*Primary Examiner*—Nile C. Byers, Jr.

*Attorney, Agent, or Firm*—Andrus, Sceales, Starke & Sawall

[57] ABSTRACT

A method and apparatus for asphalt paving in which existing asphalt pavement is removed, mixed with additives and relaid as a fresh layer of pavement. The apparatus includes a train, composed of a series of cars or trailers, which is adapted to move along the roadway. The train includes a fuel operated electrical generating unit which generates electricity that is transmitted through a power line extending along the length of the train. The hot gases of combustion from the generating unit are discharged into contact with the pavement to pre-heat the pavement. Following the pre-heater in the train, is a microwave heating unit which is connected to the power line and operates to soften the pavement. Additional aggregate, asphalt and other additives can be applied to the existing softened pavement ahead of a planar, or other pavement removing unit. The planar acts to remove the softened pavement, along with the added materials, and the mixture is then conveyed to a second microwave heating unit, located behind the planar in the train, where the mixture is heated to a temperature sufficient to melt the asphalt. The mixture is then passed through a rotating drum, which follows the second microwave heating unit in the train, to further mix the components and is then delivered to a paver for application to the roadway as a new layer of pavement. The paver is followed by a hot and cold roller to attain the desired pavement density. As an alternative, the removed pavement can be hauled to a batch site where it can be mixed with additives and heated by a microwave heating unit to form a new paving batch.

8 Claims, 8 Drawing Figures

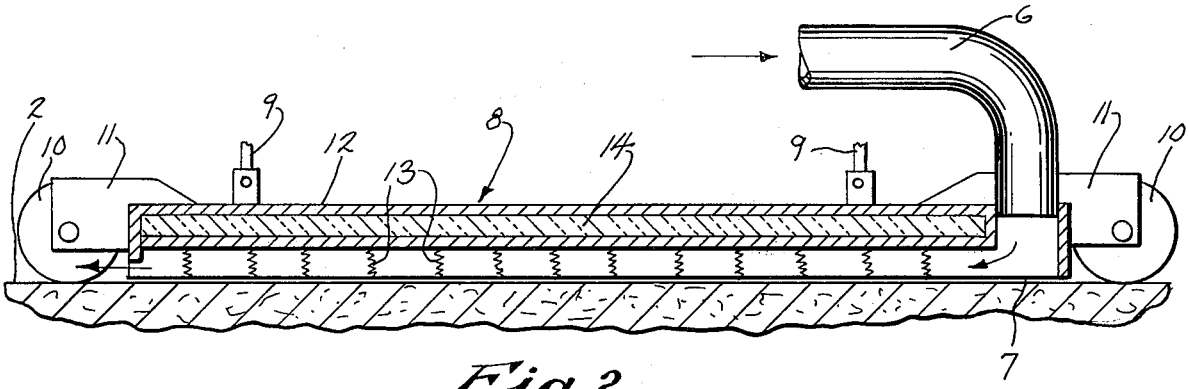
Fig. 2
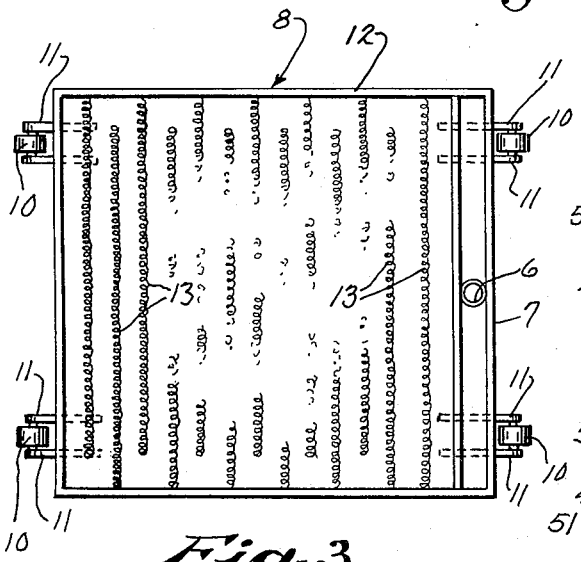
Fig. 3
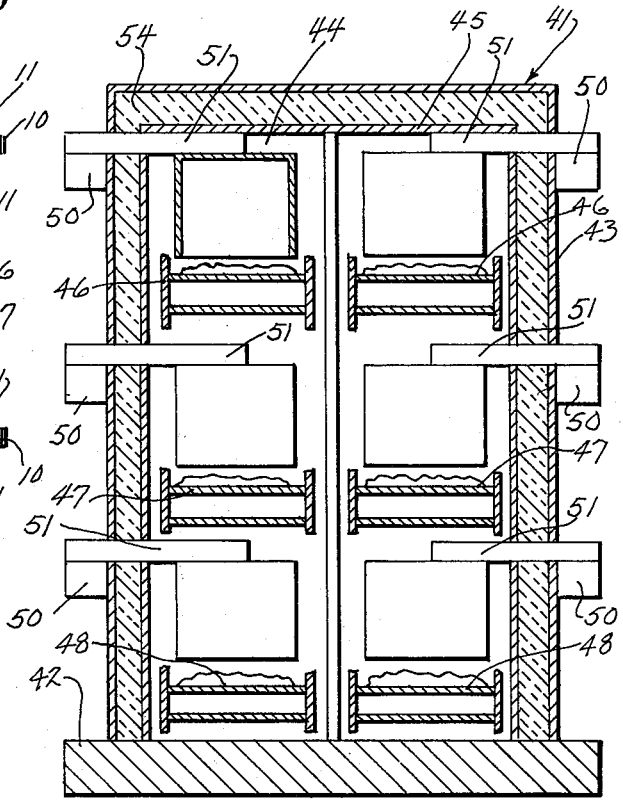
Fig. 4
Fig. 5
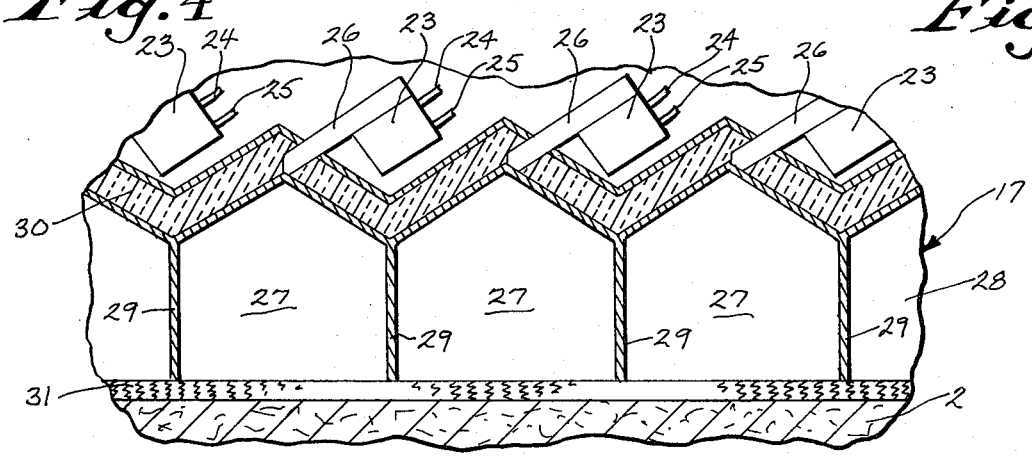

METHOD AND APPARATUS FOR ASPHALT PAVING

BACKGROUND OF THE INVENTION

Due to the escalating cost of petroleum products, it has been the recent practice in asphalt paving operations to reclaim the existing asphalt pavement. Under current practice, the existing pavement is cold milled by a huge planer machine that rips and grind the pavement into fragments about 1 inch or less in size. New aggregrate, which has not been coated with asphalt, is heated to temperatures of 800° F. to 1200° F. in a batch plant. This aggregrate is them mixed with reclaimed paving material, additional asphalt and other additives required. In so doing, the overheated new aggregate transfers heat to the reclaimed paving material and other additives. Since the asphalt is not brought into direct contact with the flame, decomposition of the asphalt and production of gaseous pollutants is somewhat reduced. The modified paving material at a temperature of 270° F. to 300° F., is then hauled back to the roadway and relaid. The cold removal of the existing pavement is particularly hard on the planer machine, resulting in high maintenance cost and repairs. Furthermore, the hauling of the removed pavement to the batch plant and returning the new mix to the roadway results in a substantial transportation cost. As a further disadvantage, the flame heating process, which is utilized in the batch plant, requires that the new aggregate be heated to a temperature of 800° F. to 1200° F. in order to adequately heat and melt the interior portions of the pavement chunks. The heat transfer at these elevated temperatures can result in decomposition of the bituminous material and the resulting emission of pollutant gases.

A second method, as practiced in the past, for reclaiming asphalt pavement has been the open flame heating of the existing pavement to soften the layer prior to removal. With this method, it is necessary to heat the outer layer of the pavement to an extremely high temperature in order to sofen the inner layers, again resulting in decomposition of the bituminous material and the production of polluting gaseous products.

SUMMARY OF THE INVENTION

The invention is directed to a continuous system for reclaiming asphalt pavement from a roadway and repaving the roadway utilizing a minimum of additives and energy. In accordance with the invention, the apparatus includes a train composed of a tractor and a number of cars or trailers, which are adapted to move progressively along the roadway. The train includes one or more electrical generating units which are operable to burn fuel and generate electricity, which is transmitted along the length of the train through a main power line. The waste gases discharged from the generating units are directed downwardly into contact with the existing pavement to pre-heat the pavement.

Located behind the electrical generating unit is an asphalt spray bar which sprays a coating of liquid asphalt onto the existing pavement ahead of a microwave heating unit. The asphalt coating reduces reflection of the microwaves and acts as an absorption interface between the microwaves and the pavement.

The generated microwaves directed at the pavement, produce a temperature of about 140° F. to 300° F. within the pavement to soften it and enable the pavement to be more readily removed by a planer which follows the microwave unit in the train.

The softened pavement removed by the planer can be hauled away to a storage site for subsequent use in new batches of pavement, or preferably, it is delivered to a second microwave heating unit located in a trailer behind the planer. In this continuous paving system, additional aggregate, sand and bituminous material can be applied to the softened pavement ahead of the planer, so that the additional materials and the removed pavement will be pre-mixed and delivered to a second microwave unit which heats the materials to a temperature generally in the range of about 270° F. to 300° F. The heated materials are conveyed from the second microwave unit to a rotating drum in a following trailer where the materials are completely mixed together. Subsequently, the mixed materials are conducted to a conventional paver, which is located behind the mixing drum in the train, and which applies the materials to the roadway as a fresh layer of pavement. The paver is followed by a conventional hot roller and cold roller to obtain the desired compaction of the fresh layer of pavement.

The invention provides a system for removing existing asphalt pavement and utilizing the removed pavement in a fresh layer of pavement that is applied to the roadway in a continuous process. The use of microwave energy to heat the asphalt results in the asphalt being heated relatively uniformly throughout its thickness without appreciable heat loss or decomposition of the asphalt. Thus, the process minimizes the emission of gaseous pollutants to the atmosphere.

As it is a continuous process, hauling of the removed pavement, as well as hauling a fresh batch of pavement to the roadway is eliminated, which substantially improves the cost factor in the laying of asphalt pavement.

The existing pavement can be pre-heated prior to removal, both by the exhaust gases of the electrical generating units and by the microwave preheating unit. With this type of pre-heating, decomposition of the asphalt is avoided and no gaseous waste products are produced. The pre-heating facilities the removal of the pavement by the planer, and enables planers of less expensive construction to be used, as compared to operations in which the existing pavement is cold milled.

Other objects and advantages will appear in the course of the following description.

DESCRIPTION OF THE DRAWINGS

The drawings illustrate the best mode presently contemplated of carrying out the invention.

In the drawings:

FIG. 2 is an enlarged vertical section of the preheater for the pavement;

FIG. 3 is a bottom view of the preheater of FIG. 2;

FIG. 4 is an enlarged vertical section showing the details of the microwave preheating unit; and FIG. 5 is an enlarged vertical section showing the details of the microwave heating unit and conveyor.

DESCRIPTION OF THE PREFERRED EMBODIMENT

Figure 1A:
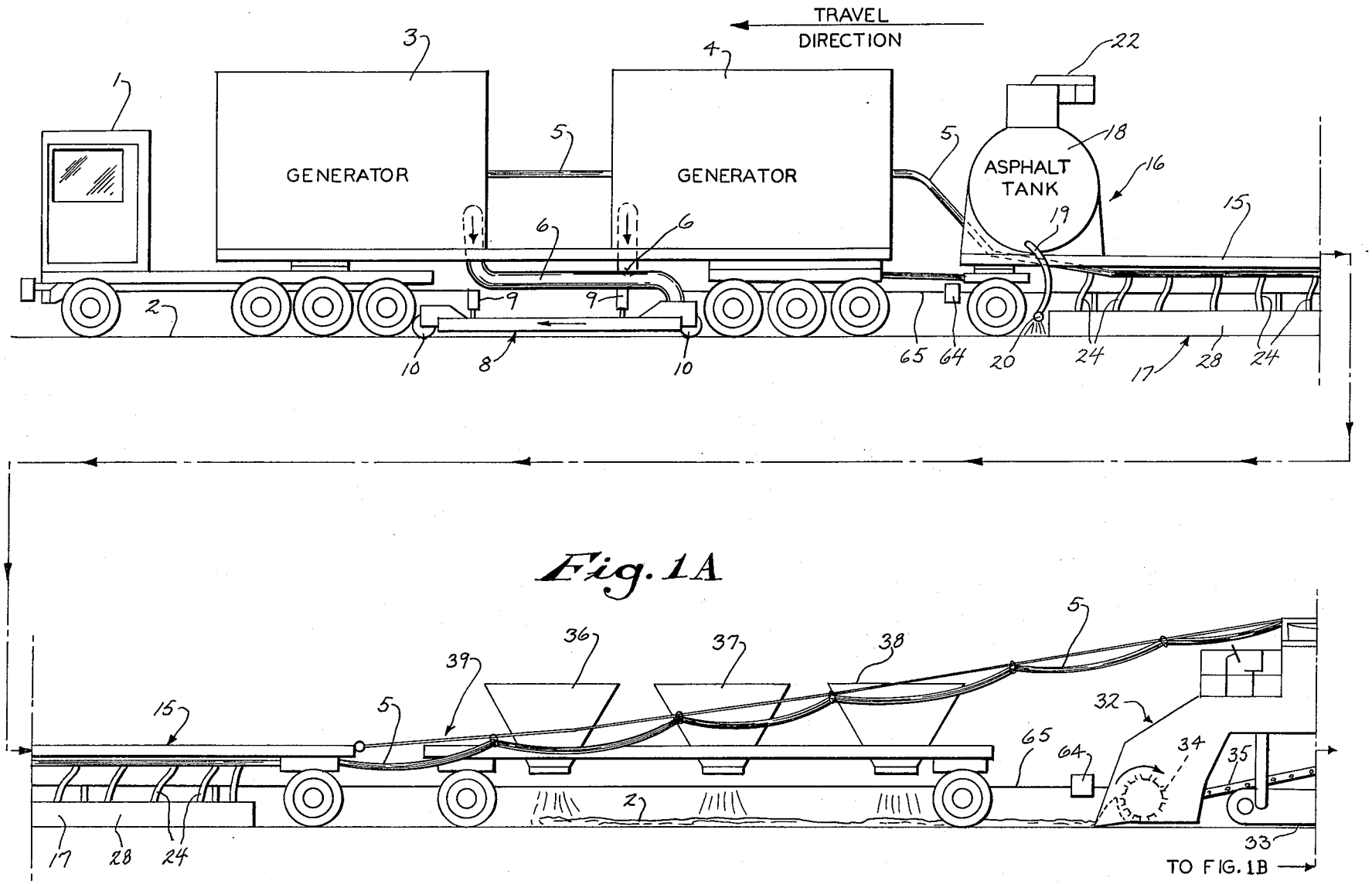
FIGS. 1A and 1B are schematic representations of the apparatus of the invention.

FIG. 1 illustrates a train which is adapted to remove the existing asphalt pavement from a roadway and apply it with additives, if required, as a new layer of pavement to the road. The train comprises a tractor 1 and a series of following cars or trailers which are adapted to travel over the roadway 2. The first two trailers in the train are electrical generator units 3 and 4. The generating units can be oil fired, turbine powered units which produce upward of 8000 KW of D.C. power, or A.C. power converted to D.C. The electrical power is transmitted along the length of the train through a main power line 5.

To preheat the existing pavement 2, the hot waste gases of combustion from the generating units 3 and 4 directed downwardly into contact with the pavement. More particularly, an exhaust pipe 6 is connected to each generating unit and conducts the hot exhaust gases from the generating unit to a header 7, which is located at the rear of a generally rectangular preheating unit 8.

The preheating unit 8, which is best illustrated in FIGS. 2 and 3, is mounted for vertical movement with respect to the pavement 2 by a conventional lifting mechanism, such as hydraulic cylinder units 9, as shown in FIG. 1, which interconnect the preheating unit 8 and the chassis of trailer 4. During operation, the preheating unit 9 will be supported from the pavement by a series of wheels or casters 10 which are mounted through brackets 11 to the housing 12 of the preheating unit. The wheels 10 serve to space the lower edge of the housing slightly above the pavement. The gases entering the housing 12 through the header 7 serve to preheat the asphalt pavement 2 and exit from the housing through the open forward end. A series of chain curtains 13 extend laterally in spaced relation across the housing and serve to reduce the noise of the gas discharge and distribute the exhaust gases over the pavement. In addition, the top of the housing and exhaust pipe can be provided with an insulating layer 14 to aid in maintaining the heat within the housing and providing a more efficient transfer of heat to the pavement.

When the preheating unit 8 is not being utilized, it can be lifted several inches above the pavement through operation of the lift cylinders 9.

Located behind the electrical generating unit 4 in the train, is a trailer 15 which includes a liquid asphalt spray unit 16 and a microwave heating unit 17. The asphalt spray unit includes a tank 18 to contain asphalt and having a discharge conduit 19 which is connected to a spray bar 20 that extends laterally across the pavement 2. The molten asphalt is distributed from the spray bar 20 through a series of outlets or jets to provide a coating of molten asphalt on the existing pavement 2. The black asphalt coating reduces reflection of the microwaves, acting as an absorption interface between the microwaves and the pavement.

The asphalt in the tank 18 can be heated to the molten state by a microwave heating unit 22 which is similar in construction to the microwave heating unit 17 which will be described in detail hereinafter.

The microwave heating unit 17, which is mounted on the trailer 15, serves to soften the pavement 2 prior to the pavement being removed from the roadway. As best shown in FIG. 4, the heating unit 17 includes a series of conventional microwave generators 23 which are located in series along the length of the trailer. D.C. power is supplied to each generator 23 through a power supply line 24, which is connected to the main power line 5 and low voltage A.C. power for the cathode heater is supplied to each generator through a power line 25.

A wave guide 26 is connected to each generator 23 and directs the microwaves into separate chambers 27, which are spaced apart in housing 28 by spaced divider walls 29. The divider walls, side walls and top of the housing 28 are preferably formed of microwave non-absorbent material, such as stainless steel, and a layer of insulation 30 is located along the top of the housing 28 and encloses the upper ends of the chambers 27.

Peripheral shielding in the form of a link chain 31 extends downwardly from the side and end walls of the housing 28 into contact with the pavement 2.

The microwave heating unit 22 which is utilize to heat and liquify the asphalt in tank 18 is constructed in a manner similar to that of microwave unit 17 so the structure of unit 22 will not be described in detail.

The microwave heating unit 17 is adapted to heat the pavement 2 to a temperature of about 140° F. to 300° F., to soften the pavement, so that it can be readily removed by a planer 32 which follows the trailer 15. The planer is illustrated as being a self-propelled unit having driven crawlers 33 which move over the pavement 2. The planer 32 is a conventional automatic, grade-controlled type having a rotating cutter or planer 34 which rips and mills the pavement 2 and deposits the chunks or particles of pavement onto inclined conveyors 35.

The existing pavement 2, as removed from the roadway, will probably not have the proper composition to be merely melted and relaid as a new layer of pavement, and depending on its composition, additional aggregate, sand, bituminous material and/or additives, may be mixed with the removed pavement. A convenient manner of mixing the additional materials with the existing pavement is to apply the materials to the pavement just prior to its removal so the materials will be mixed with the pavement as it is removed.

The drawings illustrate three hoppers 36, 37 and 38, which are mounted on a trailer 39 that follows the trailer 15 and can contain, for example, aggregate, sand, and bituminous material. Depending upon the composition of the pavement which is being removed from the roadway, predetermined quantities of aggregate, sand and bituminous material are discharged from the hoppers 36–38 onto the pavement ahead of the planer 32. To minimize dust pollution and improve the efficiency of the microwave heating, the virgin material, such as the aggregate and sand, can be spray-coated with asphalt prior to being mixed with the reclaimed pavement.

As the planer 32 removes the existing pavement, the added components are mixed into the removed pavement and conveyed upwardly on the conveyors 35 and delivered to a hopper 40 on the front end of a microwave processing unit 41, which is mounted on trailer 42. The microwave processing unit 41 serves to heat the removed pavement, additional aggregate, newly added asphalt and other additives, to the melting temperature of the asphalt to provide a new batch of paving material.

Figure 1B:
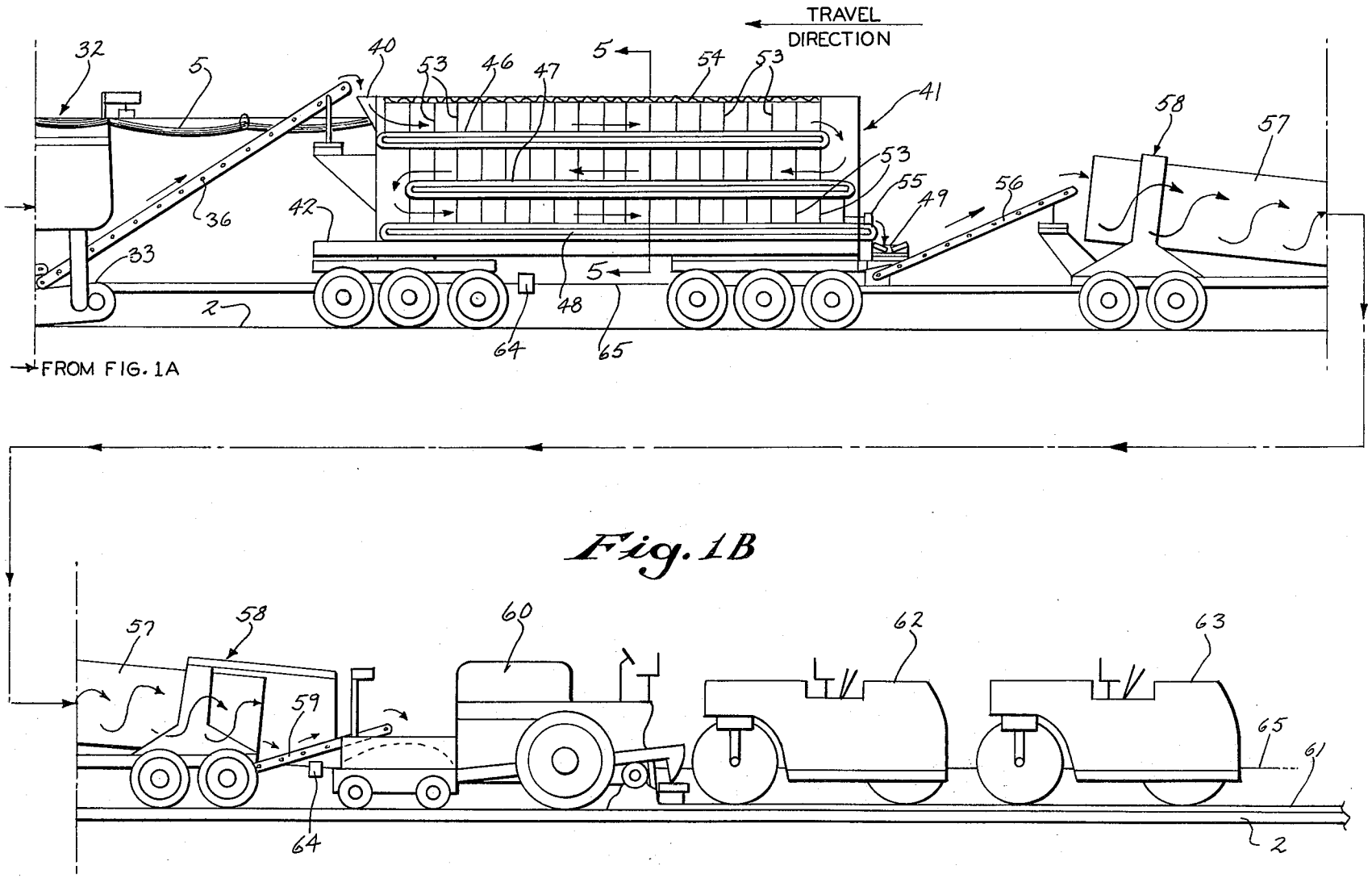

As shown in FIGS. 1B and 5, the processing unit 41 includes a housing 43 which houses two side-by-side heating assemblies 44 and 45, each of which includes three vertically superimposed endless belt conveyors 46, 47 and 48. The conveyors are formed of a microwave non-absorbent material, such as stainless steel link belt. The mixture being conveyed upwardly by conveyor 36 is deposited in the hopper 40 which distributes the mixture on the uppermost conveyor 46.

As shown by the arrows in FIG. 1B, the mixture flows from conveyor 46, to conveyor 47 and then to conveyor 48 where it is discharged into a hopper 49 located at the rear of trailer 42.

To heat the mixture as it is being moved over the conveyors 46–48, microwave generators 50 and wave guides 51 are associated with each of the conveyors and the microwaves are directed into an open-bottom hood or shield 52 which is positioned above the conveying run of each conveyor. As in the case of microwave heating unit 17, transverse walls 53, preferably formed of microwave non-absorbent material, extend across each shield and are spaced above the conveying run of the conveyor. For radiation protection to workers, and to prevent the dissipation of heat, a layer of insulation 54 can be applied to the microwave non-absorbent wall of the housing 43.

Temperature sensors 55 are located at the discharge end of the lower conveyor 48 and sense the temperature of the heated mixture being discharged from the conveyor. The temperature sensors 55 are operably connected to the microwave generators 50 to vary the number of units in operation to provide the desired discharge temperature. The final mix temperature is preferably in the range of 270° F. to 300° F. The microwave heating causes the chunks or particles of the asphalt to heat relatively uniformly throughout their thickness without vaporization or decomposition of the volatile components. This substantially eliminates the generation of gaseous pollutants during the heating process.

The hopper 49 contains a transverse auger conveyor, not shown, which conveys the heated materials toward the center of the hopper where the materials are deposited on the lower end of an inclined conveyor 56 which delivers the heated mix to the upper end of an inclined insulated rotating drum 57 mounted on a trailer 58 connected behind trailer 42 in the train. The drum 57 is a conventional type containing an internal spiral flight which provides intimate mixing of the components as the drum rotates about its axis.

The mixture is discharged from the lower rear end of the drum 57 onto an endless belt conveyor 59 which delivers the material to a conventional paver 60. The paver deposits the mixture as a fresh layer of pavement 61 and the layer 61 is compacted in a conventional manner by a hot roller 62 and a cold roller 63.

The direction of movement of the steerable units, such as the tractor 1, planer 32 and paver 60, and the elevation of the planers, are controlled by conventional sensors 64 that follow a taut cord 65 set at a predetermined elevation and alignment along the edge of the pavement 2.

The travel speed of the train can be automatically controlled by the travel of the paver 60 or the production capacity of the microwave units 17,41 through conventional sensors and overrides between unconnected sections of the train. The tractor 1 pulling generators 3 and 4 and the microwave unit 17, as well as the planer 32 and paver 60, can be equipped with automatic transmissions, thus allowing the operation of the units by the travel sensors.

While the above description has shown an operation for removing existing pavement and applying a new layer of paving material in a continuous operation, it is contemplated that in certain installations, the removed pavement can instead be delivered to trucks and hauled to a batch site where it can be mixed with additional quantities of aggregate, sand and bituminous materials to form a new bath. The microwave processing unit 41 can be incorporated in the batch-type operation, after the recycled paving material is mixed with additives, to melt the bituminous material or asphalt. After mixing and heating, the new batch can be hauled back to the roadway and relaid as a fresh layer of pavement.

Various modes of carrying out the invention are contemplated as being within the scope of the following claims particularly pointing out and distinctly claiming the subject matter which is regarded as the invention.

We claim:

1. An apparatus for asphalt paving, comprising a train having a forward end and a rear end and disposed to move in a forward direction along a roadway having an existing layer of asphalt pavement, an electrical generating unit mounted on the forward portion of the train and operable to burn a fuel and generate electricity, said generating unit having a waste gas discharge conduit for discharging waste gases of combustion, an electric power line connected to the generating unit and extending along the train to transmit electrical power, a pavement pre-heating unit mounted on the train adjacent the generating unit and operably connected to said conduit for discharging said waste gases into contact with said pavement to pre-heat the same, a first microwave heating unit connected to the train at a location to the rear of said pre-heating unit and operably connected to the power line for generating microwave energy and directing said microwave energy against said pavement to soften the pavement, pavement removing means connected to the train and located to the rear of said first microwave heating unit for removing the pre-heated layer of pavement from the roadway, means located to the rear of said first microwave heating unit for adding additional materials to the removed asphalt pavement to provide a new batch, a second microwave heating unit connected to the train and located to the rear of said pavement removing means for receiving said batch and generating microwave energy of sufficient intensity to heat the batch and melt the asphalt, and means disposed to the rear of said second microwave heating unit for applying the heated batch onto the roadway as a fresh layer of pavement.

2. The apparatus of claim 1, and including coating means located on said train forwardly of said first microwave heating unit for applying a coating of liquid asphalt to the pavement on the roadway.

3. The apparatus of claim 2, wherein said coating means comprises a tank connected to the train and containing asphalt, a third microwave heating unit connected to said power line for heating the asphalt in the tank to melt the same, and a delivery member connected to the tank for delivering the molten asphalt to the pavement as a coating.

4. The apparatus of claim 1, and including a mixing drum connected to the train and located to the rear of the second microwave heating unit for mixing the heated batch prior to the batch being laid onto the roadway as said fresh layer.

5. The apparatus of claim 1, and including temperature sensing means disposed at the rear end of the second microwave heating unit for sensing the temperature of the heated batch and for varying the electrical energy supplied to the microwave heating unit in accordance with said temperature to thereby maintain the batch at a substantially uniform temperature.

6. The apparatus of claim 1, wherein said means for adding materials comprises means located forwardly of said pavement removing means for applying said materials to the pavement forward to said pavement removing means whereby said materials are mixed with said pavement as said pavement is removed.

7. The apparatus of claim 1, wherein said pavement removing means comprises a rotary cutter.

8. The apparatus of claim 1, and including a conveyor to convey the batch through the second microwave heating unit.

* * * * *